US008057261B1

(12) United States Patent
DeSio et al.

(10) Patent No.: US 8,057,261 B1
(45) Date of Patent: Nov. 15, 2011

(54) FLAG TERMINAL INSULATOR

(75) Inventors: Joseph P. DeSio, Cranston, RI (US); Cris S. Gravel, Foster, RI (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 12/917,694

(22) Filed: Nov. 2, 2010

(51) Int. Cl.
*H01R 13/40* (2006.01)

(52) U.S. Cl. ..... 439/625; 439/694; 439/855

(58) Field of Classification Search ..... 439/625, 439/694, 733.1, 752, 855, 881, 902
See application file for complete search history.

(56) References Cited

U.S. PATENT DOCUMENTS 3,771,111 A * 11/1973 Pritulsky ..... 439/850
4,298,243 A * 11/1981 Swengel et al. ..... 439/730
4,427,257 A 1/1984 DeMarco
4,602,836 A 7/1986 Garretson et al.
6,837,745 B2 * 1/2005 Takada et al. ..... 439/595
7,198,526 B1 4/2007 MacNeil et al.
7,530,861 B2 * 5/2009 Nakamura ..... 439/854
2002/0009924 A1 * 1/2002 Little et al. ..... 439/625
2003/0232543 A1 * 12/2003 Takada et al. ..... 439/694

OTHER PUBLICATIONS

Female Flag Disconnect Assembly Mechanical Drawing, ETCO, Inc., Jan. 24, 2007.
Crimped Insulator Sales Drawing, Molex Incorporated, Jan. 6, 2005.
Flag Receptacle Assembly Mechanical Drawing, Tyco Electronics Corporation, Jul. 8, 1993.

* cited by examiner

*Primary Examiner* — Tulsidas C Patel
*Assistant Examiner* — Travis Chambers
(74) *Attorney, Agent, or Firm* — Altman & Martin; Steven K Martin

(57) ABSTRACT

An insulator adapted to receive a flag terminal. The insulator has a housing and a rear cover. The housing has an L shape with a base and a riser. The housing has a rectangular terminal opening at the base and a cavity that receives the flag terminal through the terminal opening. The flat is shaped to fit within the terminal opening and is secured by a securing mechanism that includes tabs on the cover that fit into apertures in the housing. The cover is installed by pushing it into the terminal opening. The housing flexes so that the tabs to snap into the corresponding apertures, thereby securing the cover in the terminal opening.

3 Claims, 2 Drawing Sheets

FLAG TERMINAL INSULATOR

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical connectors, more particularly, to insulators for flag terminals.

2. Description of the Related Art

Quick-connect terminal connectors are female terminals that mate with male tab terminals, tab adapters, and tab terminal blocks. They are used where quick attachment and removability are desired. Flag terminals have the quick attachment at a right angle to the electrical wire to which the terminal is attached. They are available with open or closed barrel crimps (indentor, confined, or a combination of the two), B (single) crimps, or F (double) crimps.

Flag terminals are available fully insulated, partially insulated, or non-insulated. Fully insulated terminals have a flexible insulator surrounding the terminal. The insulator deforms in order to crimp the terminal onto the wire. Partially insulated terminals can also come with a flexible insulator but the insulator does not cover the entire terminal. With other partially insulated terminals, the terminal is inserted into the insulator after the wire is attached. The resulting terminal/insulator assembly leaves the terminal exposed through the opening through which the terminal is inserted. Recently proposed standards for consumer appliances, such as dishwashers, will require that flag terminals be fully insulated to avoid accidental contact with exposed terminals.

BRIEF SUMMARY OF THE INVENTION

An object of the present invention is to provide an insulator that fully insulates a flag terminal.

The insulator of the present invention is adapted to receive a flag terminal with a female quick attachment perpendicular to the electrical wire connection. The insulator has a housing and a rear cover. The housing has an L shape with a base and a riser. The base has a rectangular terminal opening at the bottom, a tab opening in the riser, and a wire opening at the side of the base. The housing cavity receives and, optionally, capture a flag terminal through the terminal opening.

The cover is flat and is shaped to fit within the terminal opening and is secured to the housing by a securing mechanism that includes tabs on the cover that fit into apertures in the housing. The cover has first tabs on a first long edge and the housing has corresponding first apertures adjacent to the terminal opening first long edge. The cover has second tabs on a second long edge and the housing has corresponding second apertures adjacent to the terminal opening second long edge.

After the flag terminal with an attached wire is installed in the housing through the terminal opening, the cover is installed by mechanically pushing it into the terminal opening. The housing flexes to allow the tabs to snap into the corresponding apertures, thereby securing the cover in the terminal opening.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 3:
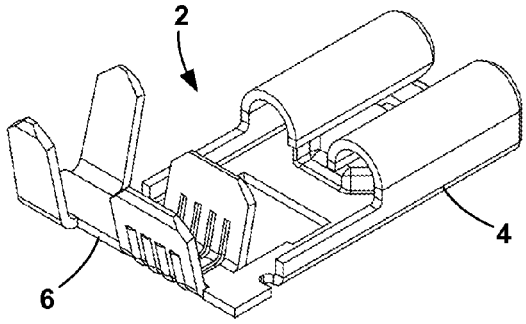
FIG. 3 Prior Art
FIG. 3 is a perspective view of a prior art flag terminal.
Figure 4:
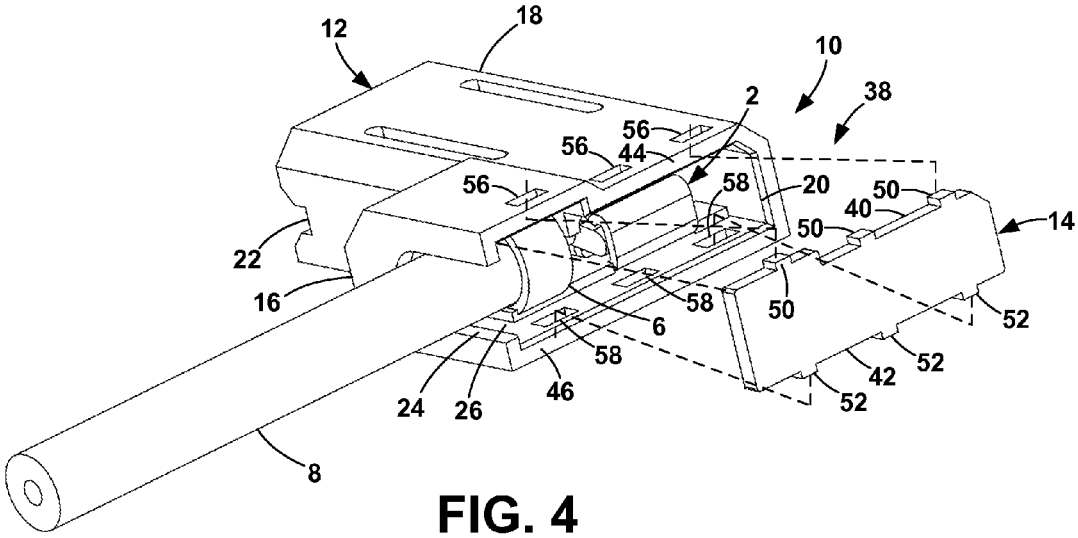
FIG. 4 is a perspective view showing the insulator of FIG. 1 with a flag terminal installed in the housing.

The insulator 10 of the present invention is adapted to receive a flag terminal 2, an example of which is shown in FIG. 3. The flag terminal 2 has a female quick attachment 4 perpendicular to the electrical wire connection 6. The wire connector 6 can be an open or closed barrel crimp, a B crimp, an F crimp, a solder connection, or any other type of wire connection available.

Figure 1:
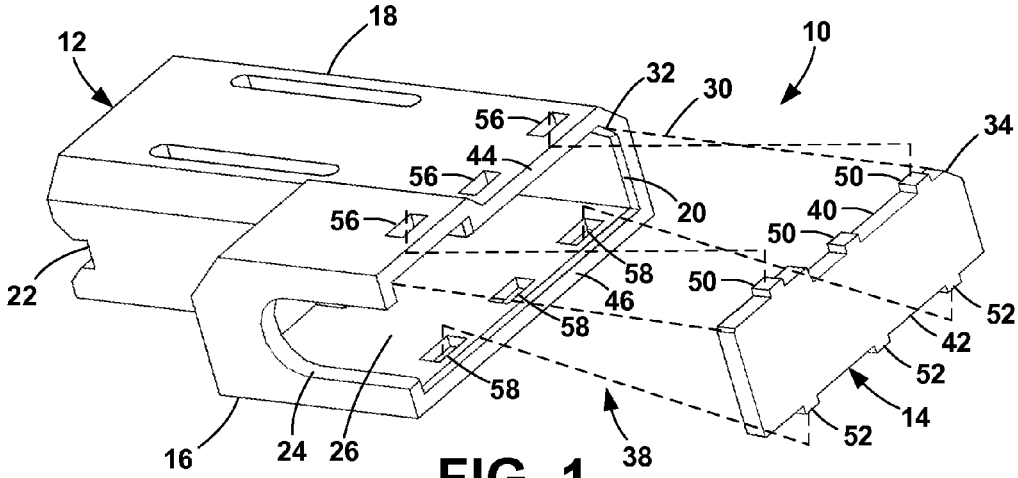
FIG. 1 is a perspective, exploded view of one embodiment of the flag terminal insulator of the present invention.
Figure 2:
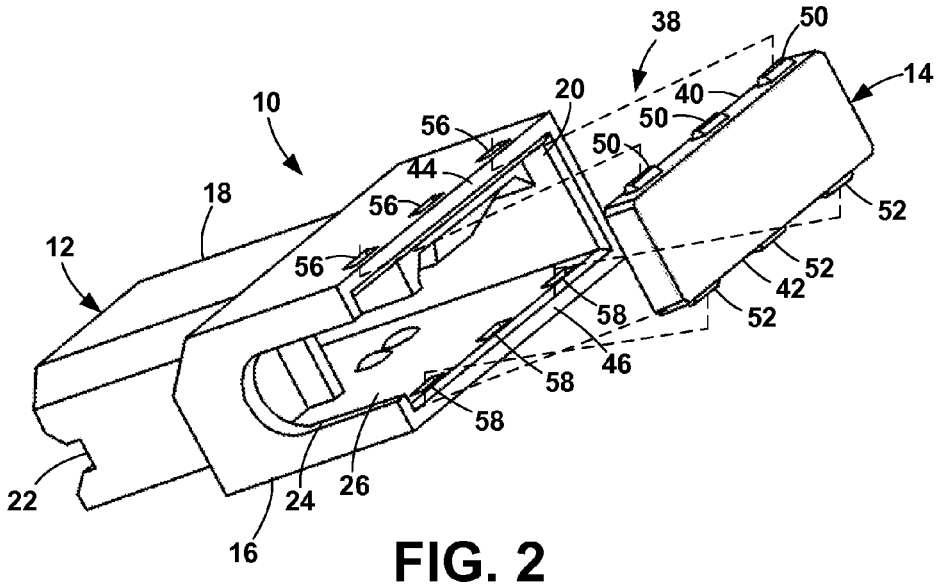
FIG. 2 is a perspective, exploded view of another embodiment of the flag terminal insulator of the present invention.

The insulator 10 of the present invention, shown in FIGS. 1 and 2, has a housing 12 and a cover 14. The housing 12 is L-shaped with a base 16 and a riser 18. The housing 12 has a generally rectangular terminal opening 20 at the bottom of the base 16 for receiving the flag terminal 2, a tab opening 22 at the end of the riser 18 for receiving the male tab that mates with the female quick attachment 4, and a wire opening 24 at the end of the base 16 from which the wire 8 extends after the insulator 10 is assembled, as described below.

The cavity 26 of the housing 12 is shaped to receive and, optionally, capture a flag terminal 2 through the terminal opening 20. Since not all flag terminals 2 are the same with the same parameters and dimensions, the present invention contemplates that the insulator 10 may have a number of designs specific to particular flag terminals. Thus, the particular shape of the cavity and the optional capture mechanism employed can differ for different flag terminals and any such cavity shape and capture mechanism known in the art are contemplated by the present invention.

The insulator housing 12 is composed of an electrically insulating plastic, such as nylon. Optionally, the housing 12 is composed of a flame-retardant nylon.

The cover 14 is generally flat and is shaped to fit within the terminal opening 20. When assembled, the two longs edges 40, 42 of the cover 14 are adjacent to the two corresponding long edges 44, 46 of the terminal opening 20. Optionally, the cover 14 is keyed 30 so that it fits into the terminal opening 20 in only one orientation. An example of such a key is shown in FIG. 1 where the terminal opening 20 has a beveled corner 32 and the cover 14 has a matching bevel 34 in the corresponding corner.

The cover 14 is secured to the housing by a securing mechanism 38. In the present embodiment the securing mechanism 38 includes tabs on the cover that fit into apertures in the housing, as described below.

The cover 14 has one or more first tabs 50 on the first long edge 40 of the cover 14. The housing 12 has corresponding first through apertures 56 adjacent to the first long edge 44. Alternatively, the first through apertures 56 are closed-end apertures. The first tabs 50 fit into the first apertures 56 to secure the cover 14 in the terminal opening 20.

The cover 14 has one or more second tabs 52 on the second long edge 42 of the cover 14. The housing 12 has corresponding second close-end apertures 58 adjacent to the second long edge 46. Alternatively, the second close-end apertures 58 are through apertures.

In the embodiment of FIG. 1, the edges of the tabs 50, 52 are all about 90°, that is, the tabs 50, 52 are solid rectangles. In the embodiment of FIG. 2, the tabs 50, 52 have beveled sides that facilitate snapping the tabs 50, 52 into the corresponding apertures 56, 58.

The cover 14 is composed of an electrically insulating plastic, such as nylon or polypropylene. Optionally, the cover 14 is composed of a flame-retardant material.

The insulator 10 is assembled by first inserting the flag terminal 2 with the wire 8 attached into the terminal opening 20 until the terminal 2 is place in the cavity 26. The female quick attachment 4 is accessible through the tab opening 22 and the wire 8 extends through the wire opening 24.

The cover 14 is installed by pushing it into the terminal opening 20. The cover 14 is intended to be installed by a machine in a manner well-known in the art.

Covers 14 are on a continuous strip and the strip feeds the cover 14 into position behind the housing 12. A punch pushes the cover 14 from the strip into a rectangular tube that is aligned with the terminal opening 20. The punch continues to push the cover 14 through the tube into the terminal opening 20. The housing 12 flexes a small amount to allow the cover 14 to seat into the terminal opening 20 with the tabs 50, 52 snapping into the corresponding apertures 56, 58 thereby securing the cover 14 in the terminal opening 20. Preferably, the cover material is a bit softer than the housing material so there is some compression on the tabs 50, 52.

Figure 5:
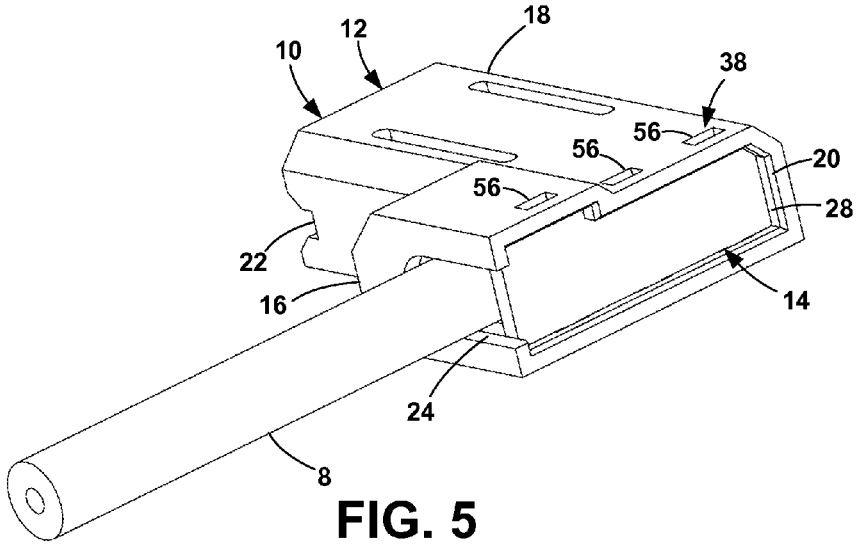
FIG. 5 is a perspective view showing the insulator of FIG. 1 fully assembled.

The cover 14 may fit flush with the terminal opening 20 or may be recessed within the terminal opening 20, as at 28 in FIG. 5.

Thus it has been shown and described a flag terminal insulator which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A flag terminal insulator for a flag terminal having a female attachment perpendicular to a wire connector, said insulator comprising:

(a) a housing having an L shape with a base, a riser, and a cavity, said base having a bottom with a terminal opening into said cavity and an end with a wire opening adjacent to said terminal opening, said riser having an end opposite said base with a tab opening into said cavity, said terminal opening being generally rectangular with a first long edge with ends and an opposed second long edge with ends, said cavity being adapted to receive said flag terminal through said terminal opening such that said female attachment is accessible through said tab opening;

(b) a generally flat, generally rectangular cover shaped to fit completely within said terminal opening and having a first long edge and an opposed second long edge; and (c) a securing mechanism for securing said cover in said terminal opening, said securing mechanism comprising at least one first tab extending from said cover first long edge, at least one second tab extending from said cover second long edge, at least one first aperture in said housing adjacent to said terminal opening first long edge, said first aperture being substantially shorter than the length of said terminal opening first long edge and not extending to said ends of said terminal opening first long edge, and at least one second aperture in said housing adjacent to said terminal opening second long edge, said second aperture being substantially shorter than the length of said terminal opening second long edge and not extending to said ends of said terminal opening second long edge, said first aperture receiving said first tab and said second aperture receiving said second tab.

2. The flag terminal insulator of claim 1 wherein said housing and cover are composed of an electrically insulating plastic.

3. The flag terminal insulator of claim 1 wherein said cavity includes a capture mechanism adapted to capture said flag terminal.

* * * * *